US006209248B1

(12) United States Patent
Reinhard

(10) Patent No.: US 6,209,248 B1
(45) Date of Patent: Apr. 3, 2001

(54) PICTURE FRAME

(75) Inventor: Siegbert K. Reinhard, Ojai, CA (US)

(73) Assignees: Donald Farnsworth; John Nava, both of Oakland, CA (US)

( * ) Notice: Subject to any disclaimer, the term of this patent is extended or adjusted under 35 U.S.C. 154(b) by 0 days.

(21) Appl. No.: 08/819,532

(22) Filed: Mar. 17, 1997

(51) Int. Cl.[7] ..... A47G 1/06

(52) U.S. Cl. ..... 40/768; 40/781; 40/772; 40/737

(58) Field of Search ..... 40/768, 781, 761, 40/772, 209, 737

(56) References Cited

U.S. PATENT DOCUMENTS

| | | | | |
|---|---|---|---|---|
| 2,099,538 | * | 11/1937 | Schultz | 40/761 |
| 2,697,889 | | 12/1954 | Heim . | |
| 2,827,722 | * | 3/1958 | Lectrerc | 40/209 |
| 2,836,916 | | 6/1958 | Piromalli . | |
| 3,371,439 | * | 3/1968 | Smith et al. | 40/781 |
| 3,530,608 | | 9/1970 | Sovia . | |
| 3,813,799 | | 6/1974 | Caravello . | |
| 3,885,336 | | 5/1975 | Olsen . | |
| 3,956,838 | | 5/1976 | Gerrish . | |
| 4,829,691 | | 5/1989 | Manjos et al. . | |
| 4,850,125 | | 7/1989 | Green . | |
| 5,018,291 | | 5/1991 | Pasquale et al. . | |
| 5,097,953 | | 3/1992 | Gingras . | |
| 5,161,320 | | 11/1992 | Shaw . | |
| 5,174,054 | | 12/1992 | Politi . | |
| 5,197,213 | | 3/1993 | Borden . | |
| 5,335,433 | | 8/1994 | Borden . | |
| 5,544,438 | * | 8/1996 | Fazekas | 40/781 |

FOREIGN PATENT DOCUMENTS

| | | | | |
|---|---|---|---|---|
| 549747 | * | 9/1955 | (BE) | 40/209 |
| 38217762 | * | 1/1990 | (DE) | 40/209 |
| 387386 | * | 2/1933 | (GB) | 40/209 |

* cited by examiner

*Primary Examiner*—Cassandra H. Davis
(74) *Attorney, Agent, or Firm*—Pretty, Schroeder & Poplawaski, P.C.

(57) ABSTRACT

A picture frame is constructed of a base member and a backing member with the backing member in some embodiments having the same configuration as the base member. The backing member, typically, is deflectable. The base member includes a border section which encloses a planar center section. Relative to the backing member, the border section is concave. The base member and backing member can be hinged. Mounted in conjunction with the border section of the base member are series of locking tabs with these tabs to be movable to fixedly retain the backing member in conjunction with the base member. A sheet material attachment is connectable with at least one pair of slits formed within the backing member able to assume an angular relationship relative to the backing member resembling an easel shape to support the picture frame in an upright manner when the attachment and a portion of the border section of the picture frame rest on a supporting surface.

19 Claims, 10 Drawing Sheets

PICTURE FRAME

BACKGROUND OF THE INVENTION

1) Field of the Invention

The present invention relates to frames for artistic art such as pictures, photographs, stitchery and needlework or printed material such as awards, certificates, licenses or news clippings. It is to be understood that in discussing this invention referring to pictures is meant to include any form of art, photographs, sketches, printed material or the like that is placed in a frame in the form of a sheet material object.

2) Description of the Prior Art

Picture frames typically comprise an assembly of an outer or base member which are constructed primarily of glass or plastic. This transparent outer member is encased within a frame. Common shapes of such frames are either oval or rectangular. The picture is mounted on the rear surface of the transparent member and then a backing member placed against the picture with the backing member being secured by appropriate securing means to the outer member. At times, there may be included in the frame a mat that surrounds the periphery of the picture with the mat being of a decorative texture and/or decorative color.

Picture frames are typically hung on a vertical surface, such as a wall, which positions the picture in a manner that facilitates observation. Picture frames are also known to be set upon a horizontal surface such as a shelf, desk, fireplace mantle, dresser and so forth. When set upon a horizontal surface, the picture frame is located in an upright position which again positions the picture frame in a manner to be readily observed. It is common that such picture frames include an attachment that protrudes at an angle from the back surface of the picture frame so the picture frame can assume an easel type position.

In the past, to make a picture frame of high quality construction required that the picture frame be manufactured with a certain expense. It would be desirable to construct the picture frame in a manner that gives the appearance of being of high quality in manufacture but yet manufactured less expensively.

SUMMARY OF THE INVENTION

A primary objective of the present invention is to construct a picture frame which is attractive in appearance, solid in construction, and which is manufactured at a cost substantially less than similar prior art picture frames.

Another objective of the present invention is to utilize a supporting leg attachment which can be easily and quickly installed in conjunction with the picture frame in order to position the picture frame in an upright easel position on a supporting surface.

Another objective of the present invention is to provide a picture frame which when displayed is aesthetically pleasing and does not distract from the picture being displayed.

Another objective of the present invention is to provide a picture frame which allows the picture being displayed to be easily changed to another type of picture.

Another objective of the present invention is to provide a picture frame which is thin and yet durable, made of a plastic material that is light in weight thereby making it practical to send, for example, a framed greeting card in the mail. This light weight quality also allows frames to be attached to a metal surface, such as a refrigerator, by means of a magnet which is fastened to the back surface of the picture frame.

Yet another object of the invention is to provide a configuration of a plurality of frame structures arranged in geometric shapes such as a cube, rectangle or a cylinder.

The picture frame of the present invention utilizes a base member which can be rigid or flexible which has a transparent planar center section. Normally this rigid base member is constructed of a plastic material. Connected to the periphery of the planar center section and completely encasing the center section is a border section with this border section being integral with the center section. This border section is of a non-planar configuration with, for example, the border section being generally concave relative to the rear surface of the base member.

A backing member is utilized which has the same shape as the base member. In one embodiment the backing member is constructed to be rigid but is formed of sufficiently thin sheet material that permits some deflection of the backing member. The border section of the backing member is to matingly connect with the border section of the base member. Alternatively, a separate matting member can be sandwiched between the base and backing members. A picture receiving compartment is formed between the base member and the backing member and within this picture receiving compartment a picture that is to be displayed is provided.

Various means may be used to maintain the border section of the base member and the border section of the backing member held in place when a picture is inserted. For example, a series of locking tabs can be connected between the border section of the base member and the border section of the backing member with the locking tabs being movable between a locked position and an unlocked position. With the locking tabs in the locked position, the backing member is securely mounted to the base member. With the locking tabs in the unlocking position, the backing member is disengageable from the base member. Other well known locking means can also be used, such as a detent arrangement, velcro, adhesives, clips, ridges and slits or other holding devices.

An attachment for supporting the frame includes a narrow upper end which is formed into a flared configuration. This flared tip section is conductible through a slit formed in the backing member to be used to support the picture-frame in an easel-type of position on a supporting surface.

DETAILED DESCRIPTION OF THE PREFERRED EMBODIMENT

Figure 1:
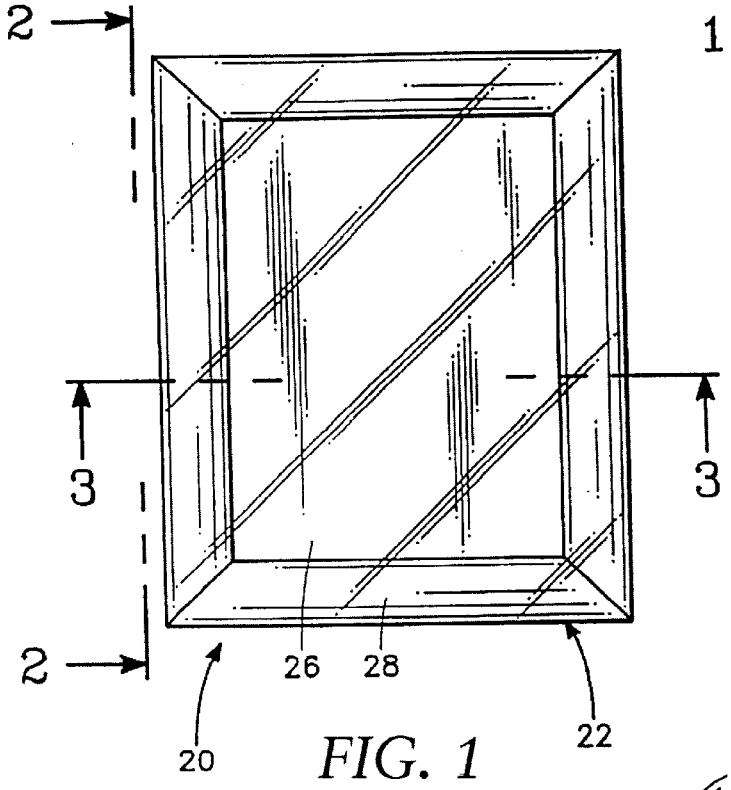
FIG. 1 is a front view of the picture frame of the present invention.
Figure 2:
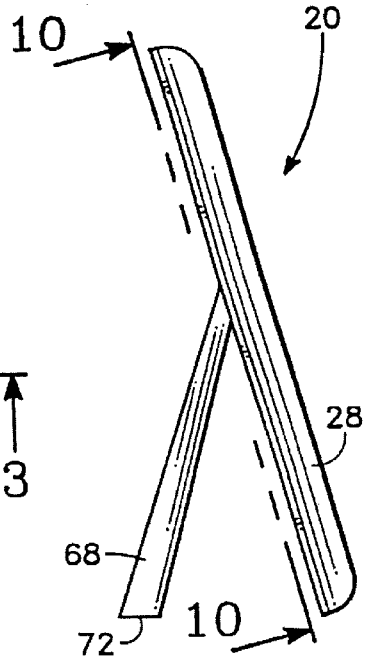
FIG. 2 is a left side view of the picture frame of the present invention showing the picture frame being supported by an easel arrangement.
Figure 3:
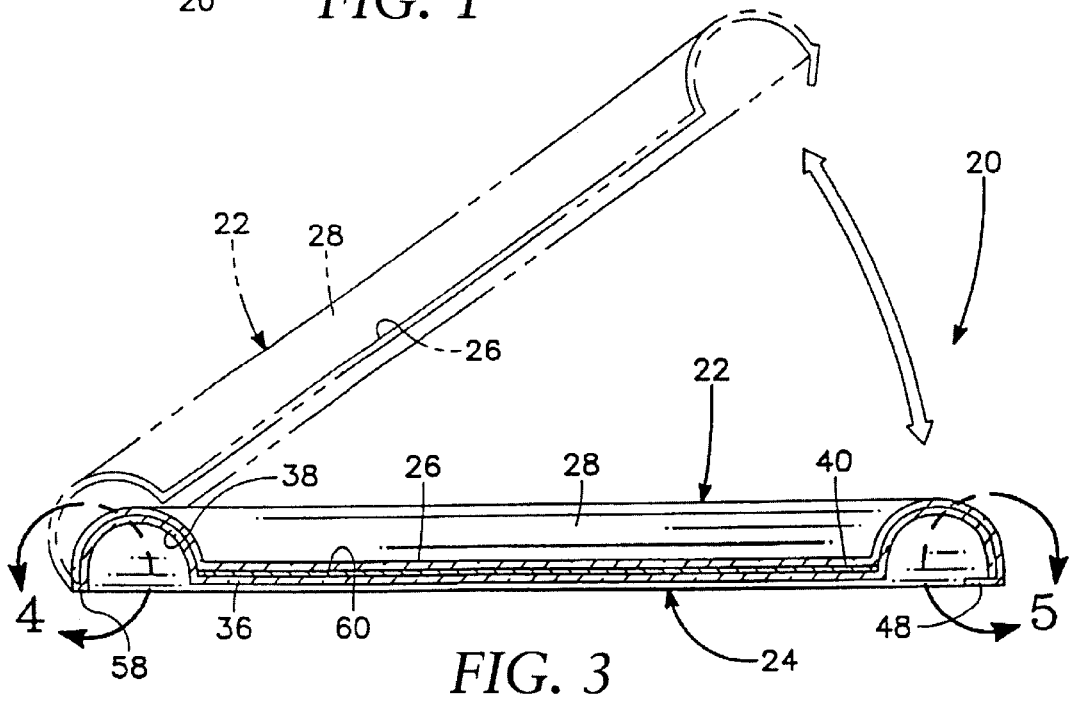
FIG. 3 is a cross-sectional view through the picture frame of the present invention taken along 3—3 of FIG. 1 depicting separation of the base member from the backing member in phantom lines with this separation occurring by pivoting of the base member relative to the backing member.
Figure 4:
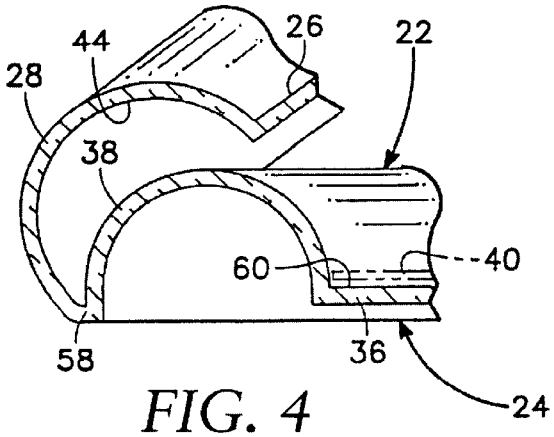
FIG. 4 is an enlarged cross-sectional view showing more clearly a hinged connection between one edge of the base member to the backing member of the picture frame taken along line 4—4 of FIG. 3.
Figure 5:
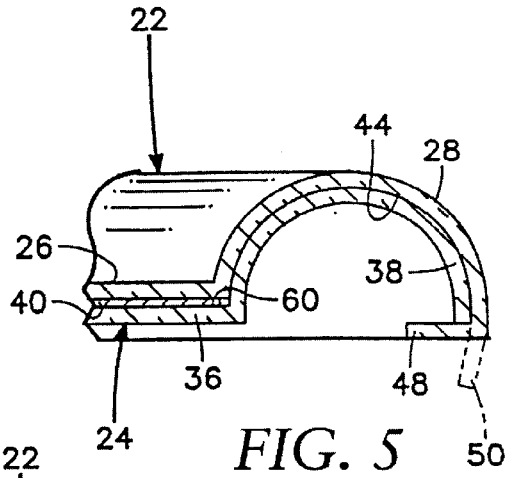
FIG. 5 is an enlarged cross-sectional view of the locking arrangement utilizing tabs between the base member and the backing member taken along line 5—5 of FIG. 3.

Referring particularly to the drawings, there is shown one embodiment of a picture frame 20 of this invention which is constructed primarily of a base member 22 and a backing member 24. The base member 22 is constructed of sheet plastic which is composed of a center section 26 and a border section 28. The center section 26 is transparent. The border section 28 can be either transparent or opaque. The center section 26 is shown as being rectangular with the border section 28 surrounding the center section 26. However, it is to be considered within the scope of this invention that the base member 22 could be other than rectangular such as oval, square or other geometric configurations. Also, the center section may be curved so as to provide a curved rather than planar picture frame.

Typically, the thickness of the plastic of the base member 22 ranges from about 1/100th of an inch to be about one-eighth of an inch depending on the overall size and dimensions of the picture frame.

The border section 28 is shown to be of a convex appearance when observed from the front of the picture frame 20 and a concave appearance when viewed from the rear of the base member 22. Numerous different concave appearances could be produced other than the smoothly contoured concave appearance shown in FIGS. 1–7 of the drawings. For example, reference is to be had to FIG. 8 where a different concave configuration of the border section is shown on border section 28.

Also, the border section 28 may be formed of colored plastic or may be coated on its inside surface with an opaque paint. In accordance with another embodiment of the invention there may be included an insert 30 between the border section 28 and the backing member 24. If the border section 28 is basically transparent so that the insert 30 is observed, then the design representation of the insert 30 will be displayed exteriorly of the border section 28. On either side of the insert 30 and formed on or within the border section 32 there may be incorporated different colors which results in a colorful border section 28.

The backing member 24 also includes a center mounting section 36. This center mounting section 36 is normally constructed of an opaque material. Surrounding and integrally connected to the center mounting section 36 is a border section 38. The configuration of the border section 38 is substantially the same shape as the border section 28 with the only difference being that the border section 38 is slightly smaller in size than the border section 28 so as to mate therewith.

An ornamental design member, which is herein generally referred to as a picture 40, is placed on the center mounting section 36. Normally, the picture 40 is substantially equal to the size of the center mounting section 36. However, if the picture 40 is a smaller size than the center mounting section 36, a matting (not shown) can be located around the picture 40 with the matting located against the border section 38 or 28. With the picture 40 properly positioned in conjunction with the center mounting center section 36, the base member 22 is placed on top of the backing member 24. The border section 38 is matingly located within the concavity 44 of the border section 28. There is a similar concavity 46 for the border section 28. The picture 40 is securely captured between the center mounting section 36 and center section 26 and held in its established position.

Typically, the backing member 24 is constructed of a plastic material ranging in thickness from about 1/100th of an inch to about 1/8th of an inch depending on the overall size and dimensions of the picture frame. This is the same thickness ratio as in the base members 22 and 42. This permits the border sections 28 and 38 to deflect slightly when assuming their position within their respective concavities 44 and 46. However, to insure that the backing member 24 remains connected to the base member 22, it is advisable to use some type of a locking device.

Figure 10:
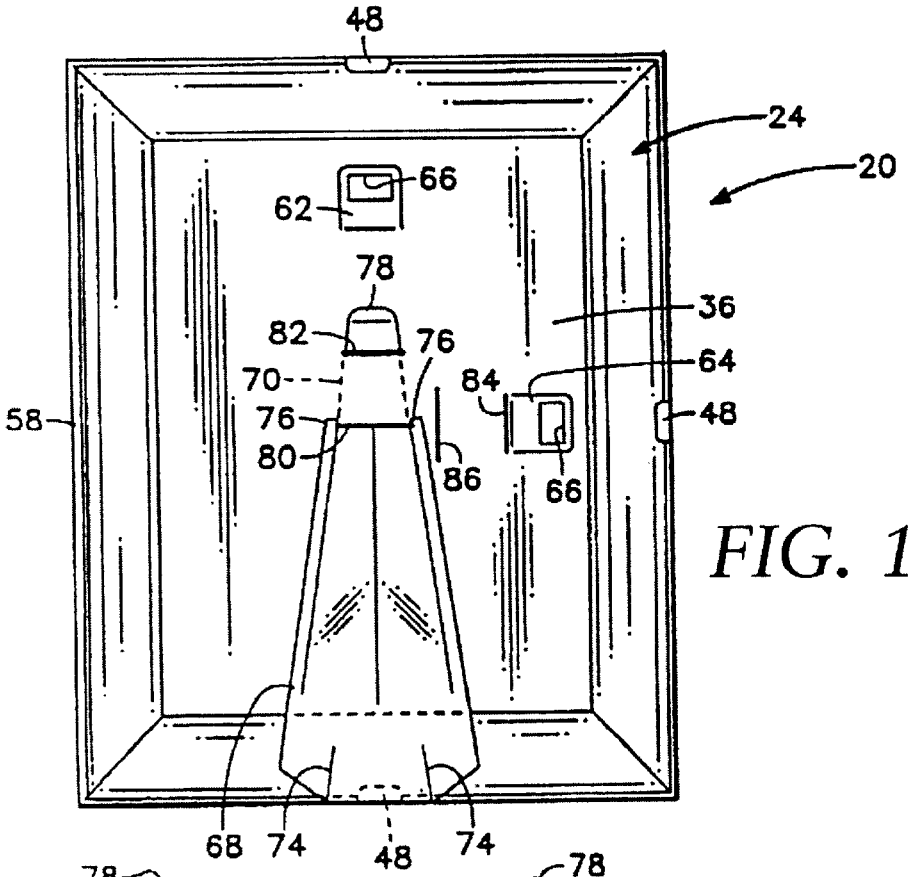
FIG. 10 is a back view of the picture frame showing the connection of the attachment that is mounted in conjunction with the backing member so as to support the picture frame in an easel type configuration.
Figure 11:
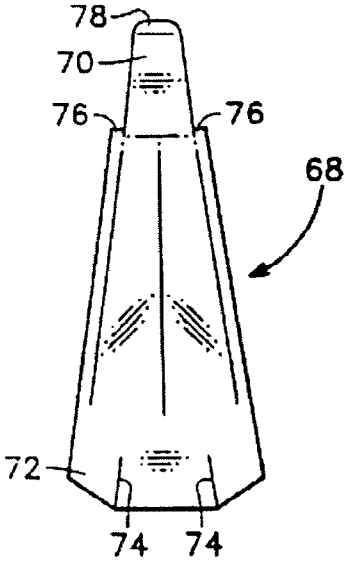
FIG. 11 is a view showing just the attachment itself.
Figure 12:
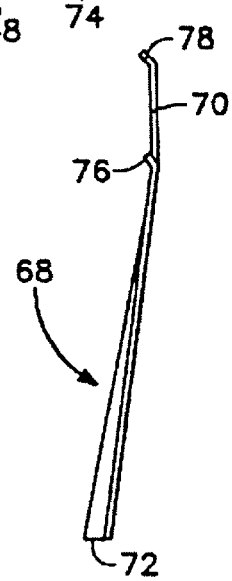
FIG. 12 is a right side view of the attachment of FIG. 11.
Figure 9:
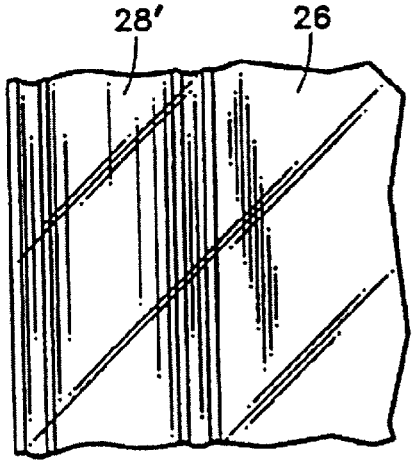
FIG. 9 is a top view configuration of the modified form of the picture frame shown in FIG. 8.

One type of such locking device is a series of locking tabs 48 that are integrally connected to the outer edge of the border section 28 at various locations around the border section 28. When the picture frame is rectangular in shape, there are four tabs 48 provided, one for each side. This is shown in FIG. 10. The locking tab 48 is bent over to a position against the outer edge of the border section 38 or 32 and remains in that position by holding in place the backing member 24. Each tab 48 is manually moved to a displaced position which is the unlocked position 50 shown in FIG. 5 of the drawings. Less tabs may be used as well.

In one modification of the locking tabs 48, instead of mounting a locking tab 48 on the border section 28, a locking tab 52 is attached to the free edge of the border section 38. The locking tab 52 is then moved to an unlocked position 54 which is shown in dotted lines in FIG. 6 which then facilitates disengagement of the backing member 24 from the base member 22. When in the locked position, the locking tab 52 is maintained in the solid line position by means of ledge 56.

It may be desirable to have the base member 22 integrally attached at one edge to the backing member 24. This integral attachment can be provided by means of a hinge 58. Here, the base member 22 is hinged to the open position as shown by the dotted lines in FIG. 3 in order to permit access to the picture retaining compartment 60 located between the base member 28 and the backing member 24. The hinge 58 replaces one of the four locking tabs 48. Therefore only one locking tab is necessary for small sized picture frames while three locking tabs are desirable for larger size picture frames.

The picture frame 20 of this invention is assembled as follows: The user typically receives the picture frame 20 in the assembled condition. The user then moves each of the locking tabs 48 to the unlocked position which permits the backing member 24 or 36 to be disengaged from its respective base member 22 and 42. The picture receiving compartment 60 is now exposed. The picture 40 is then placed within the compartment 60. The user then interconnects the base member 22 to the backing member 24 with the border section 38 being totally confined within the concavity 44 or the border section 32 being totally confined within the concavity 46. The locking tabs 48 are then moved from the unlocked position to the locked position and the picture frame 20 is now completely assembled.

The center mounted section 36 includes cut-out tabs 62 and 64. Each of the cut-out tabs 62 can be deflected slightly relative to the center mounted section 36. Each cut-out tab 62 or 64 includes a hole 66. A nail or other similar type of fastener that is secured to a vertical surface, such as a wall, can then be located within the hole 66 of the tab 62 which will result in the longest dimension of the frame 20 being located in a vertically oriented direction. If the nail is connected with hole 66 of the cut-out tabs 64, the longest dimension of the frame 20 will located in a horizontal direction.

Instead of mounting of the picture frame 20 on a wall, it may be desirable to locate the picture frame 20 in a stand up position on a supporting surface. In order to achieve that end result, an attachment 68 is utilized to cause the picture frame 20 to be mounted in an easel position on the supporting surface. The attachment 68 is formed of sheet material generally of plastic, and includes a narrowed tip section 70 and a widened base 72. The attachment 68 in the area of the widened base 72 includes a pair of crease lines 74 located in a spaced apart arrangement. The crease lines 74 cause the widened base 72 to assume a non-straight line configuration which provides a better quality of support when the widened base 72 is located on a supporting surface.

The body of the attachment 68, where it is connected to narrowed tip section 70, forms a pair of contact points 76. One contact point 76 is located on one side of the narrowed tip section 70 and another contact point 76 is located on the opposite side of the narrowed tip section 70. The free outer end of the narrowed tip section 70 is formed into an outwardly flared section 78.

Formed within the center mounted section 36 is a first pair of slits 80 and 82 and a second pair of slits 84 and 86. The flared section 78 slips into engagement with slit 80 and continues to be moved until it engages with the slit 82 of the flared section 78, which then re-emerges on the outside of the center mounted section with most of the narrowed tip section 70 being located inside of the center mounted section 36.

Figure 19:
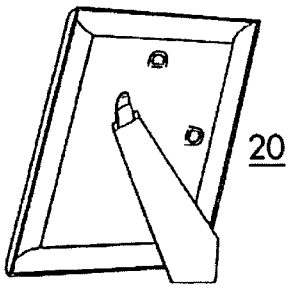
FIG. 19 shows the picture frame of the present invention supported in easel fashion with the frame vertically oriented

The contact point 76 abuts against the back side of the center mounted section 36. The user positions the attachment 68 at an angular position relative to the center mounted section 36 which positions the attachment 68 in an easel type position. The picture frame 20 is placed on a supporting surface with the longest dimension of the picture frame 20 being located vertically. See FIG. 19.

Figure 20:
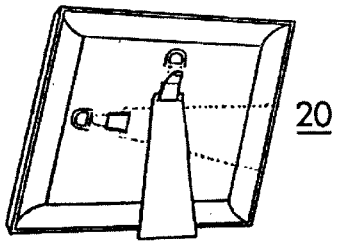
FIG. 20 shows the picture frame of the present invention supported in an easel fashion with the picture frame horizontally oriented.

If instead the user decides to insert the flared section 78 through slot 86 and then slot 84, the picture frame 20 can be placed on the supporting surface in a horizontal direction. See FIG. 20.

Figure 13:
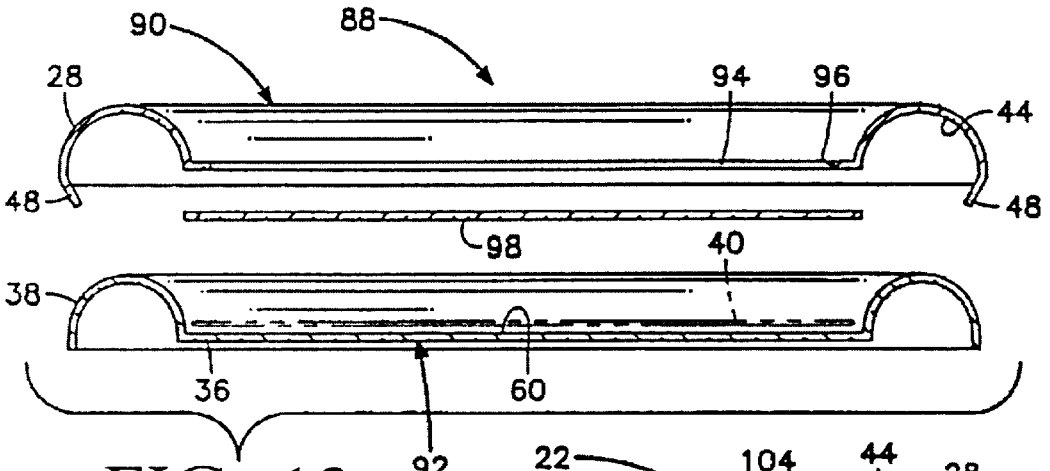
FIG. 13 is an exploded cross-sectional view similar to FIG. 7 of a modified form of picture frame wherein the transparent center section of the picture frame is separate from the base member.

Referring particularly to FIG. 13, there is shown a further modified embodiment 88 of the invention which includes a base member 90 and a backing member 92. The base member 90 also has a border section 28 which defines a concavity 44. Connected to the border section 28 are locking tabs 48. However, it is to be noted that there is no transparent section 26 and instead there is an enlarged opening 94. The edge of the enlarged opening 94 is defined by flange 96 which is integral with the border section 28.

Figure 7:
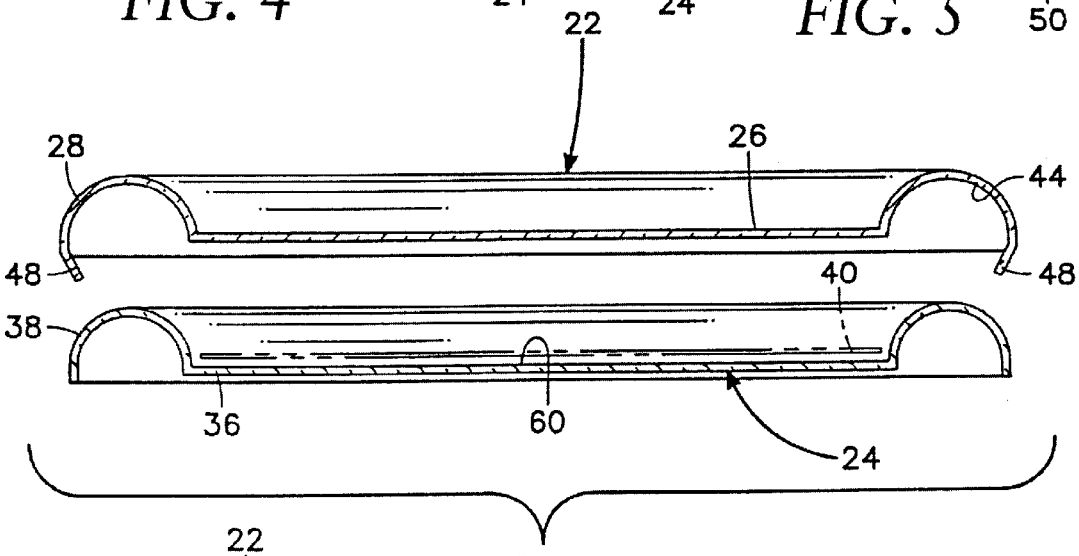
FIG. 7 is an exploded cross-sectional view of the picture frame which is composed of a base member and a backing member which are formed of two separate parts rather than being hingedly connected together as in FIG. 3.
Figure 6:
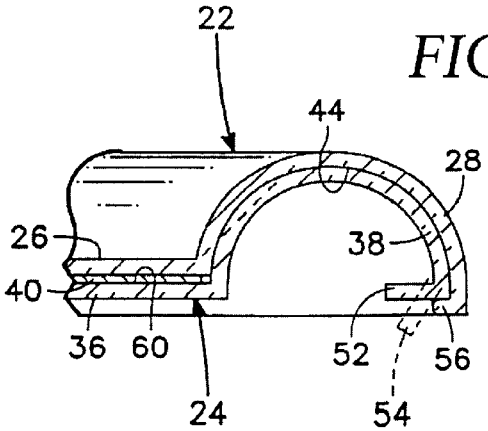
FIG. 6 is a view similar to FIG. 5 but of a modified form of locking arrangement between the base member and the backing member.
Figure 8:
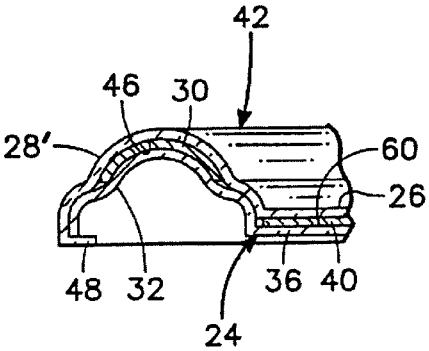
FIG. 8 is a cross-sectional view similar to FIG. 6 but of a different configuration of border sections of the picture frame.

The backing member 92 is the same as the backing member shown in FIG. 7 with like numerals being used to refer to like parts. However, mounted on the picture 40, which is located within the picture receiving compartment 60, is a transparent plate 98. The transparent plate 98 covers the picture 40 and is approximately the same size as the picture receiving compartment 60. The transparent plate 98 can comprise clear plastic or glass. Flange 96 of the base member 90 functions to securely retain in place the transparent plate 98 when the backing member 92 is mounted in conjunction with the base member 90.

Figure 14:
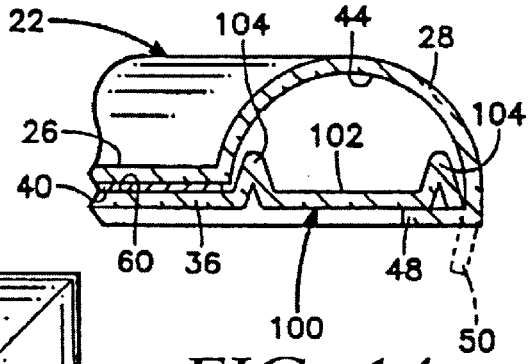
FIG. 14 is a cross-sectional view similar to FIG. 6 of a further modified form of the present invention where the backing member does not matingly conform to the base member.

Referring particularly to FIG. 14 of the drawings, there is shown a modified form of the backing member 100. The backing member 100 still has a center mounted section 36 which contacts the picture 40 which is mounted in the picture receiving compartment 60. However, the backing member 100 does not have the border section 38 but instead defines a flattened section 102. At each end of the flattened section 102 is an upstanding protuberance 104. The upstanding protuberances 104 are actually in the shape of ridges which extend all the way around the backing member 100. The function of the upstanding protuberances 104 is to provide rigidity and strength to the backing member 100.

The upstanding protuberances 104 are positioned within the concavity 44 of the base member 22. However, a volume is created between the wall of the concavity 44 and the flattened section 102. Within that concavity 44 there may be placed three dimensional design articles such as representation of flowers, brightly colored objects and so forth. The border section 28 still includes tabs 48 or other locking devices. Tabs 48 are to bendable between the unlocked position 50 and the locked position shown in solid lines in FIG. 14 which retains the backing member 100 in position in conjunction with the base member 22.

Figure 15:
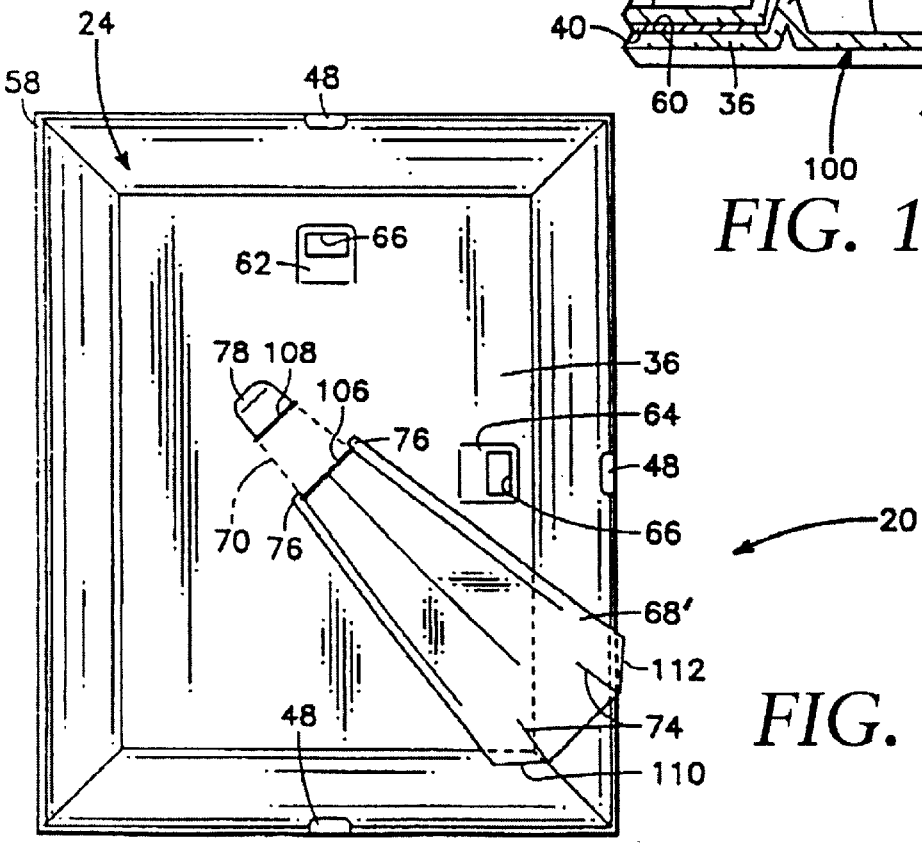
FIG. 15 is a back view similar to FIG. 10 showing a modified form of attachment that is to be used to mount the picture frame in an easel position.

Referring particularly to FIG. 15, it is to be observed that the attachment 68 is mounted at a forty-five degree angle position relative to the longitudinal center axis passing through the picture frame 20 and also at a forty-five degree angle relative to the center axis passing through the width of the picture frame 20. The narrowed tip section 70 is conducted through slits 106 and 108 which are essentially the same as slits 80 and 82 or slits 80 and 84, respectively, with the exception that the slits 106 and 108 are positioned at an angular position so the attachment assumes a forty-five degree offset position previously mentioned. The lower end of the attachment 68 includes forty-five degree offset beveled surfaces 110 and 112.

The beveled surface 110 is positioned flush against the supporting surface when the picture frame 20 is located in an upright position with the longest dimension of the picture frame 20 located vertically. If the beveled surface 112 is positioned against the supporting surface, the longest dimension of the picture frame 20 is now located horizontally. In other words, the single attachment 68 can be used to support the picture frame 20 in both its vertical orientation on the supporting surface or a horizontal orientation on the supporting surface. This eliminates the need for both sets of slits 80 and 82, 84 and 86 with only a single set of slits 106 and 108 being used instead.

Figure 16A:
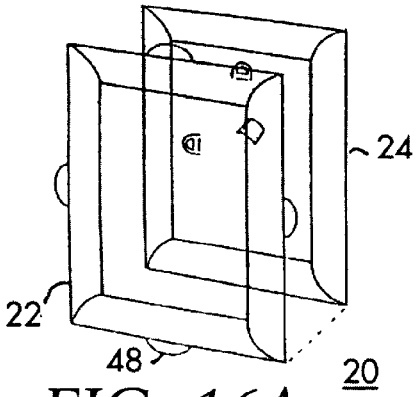
FIGS. 16A and 16B illustrate an arrangement where both the base unit and backing member are vacuum formed plastic.
Figure 16B:
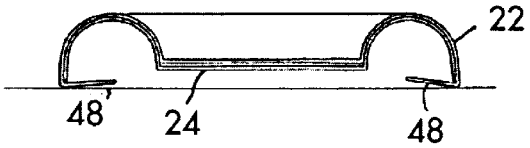
Figure 17A:
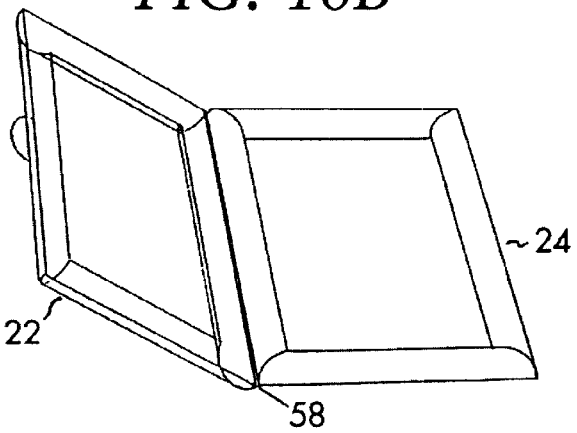
FIGS. 17A and 17B show the embodiment of FIG. 16A and 16B but with a hinge between the base and backing members.
Figure 17B:
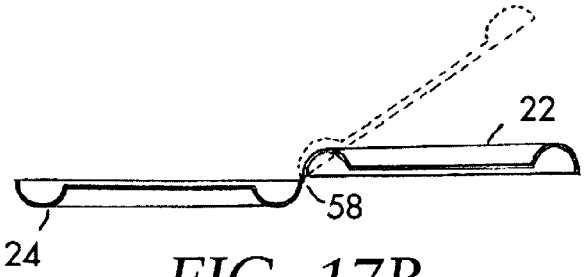

The picture frame of the present invention can be manufactured in a variety of ways. FIGS. 16A and 16B illustrate an arrangement where both the base unit 22 and the backing member 24 are vacuum formed plastic. The backing member can be transparent or opaque or a translucent, colored plastic. By using extremely thin and flexible light weight film material, an alternative to "shrink-wrap" packaging is provided. The molded configuration imparts material to realize a frame-like function in appearance. This same construction is shown in FIGS. 17A and 17B which show the hinged or integral version of the picture frame of the present invention.

Figure 18A:
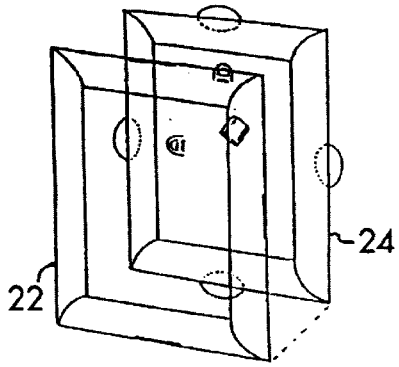
FIGS. 18A and 18B illustrate an embodiment of the invention wherein the base member is made of injection molded plastic.
Figure 18B:
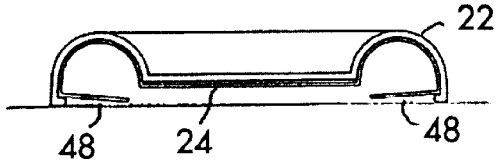

Another construction technique is shown in FIGS. 18A and 18B. Here the member 22 is made by conventional injection molding of transparent acrylic to form a rigid structure. The center section of the base member 22 forms a high quality plate and frame enclosure as a single unit. Note that with this arrangement the tabs 48 are formed as part of the backing member 24, whereas in the embodiment of FIGS. 16A and 16B, tabs 48 are formed as part of the base member 22. Likewise, both the base member 22 and the backing member 24 can be formed by injection molded acrylic.

Figure 21A:
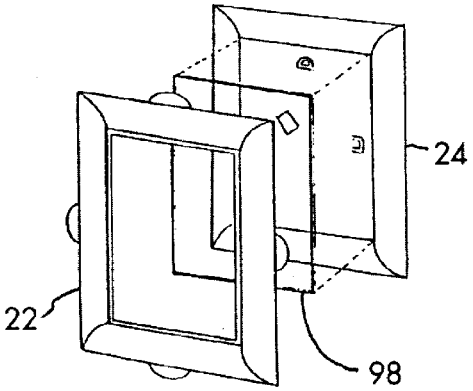
FIGS. 21A and 21B show an alternative arrangement of the present invention utilizing a separate transparent plate.
Figure 22A:
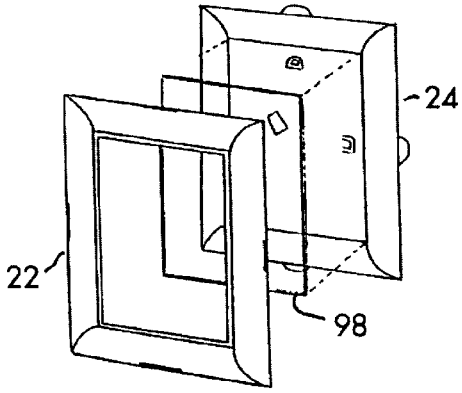
FIGS. 22A and 22B illustrate the embodiment of FIGS. 21A and 21B with a rigid backing member 24.
Figure 21B:
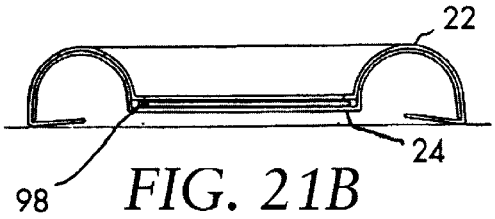
Figure 22B:
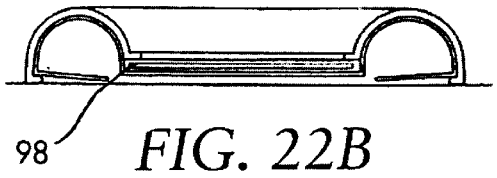

The two techniques described in connection with FIGS. 16A/16B and FIGS. 18A/18B can also be used to form the embodiment of FIG. 13 wherein a separate transparent plate 98 is provided. In the embodiment of FIGS. 21A and 21B, a separate, thin plastic sheet 98 is provided as the transparent plate. To accomplish this, the base member 22 has a central portion which is cut out so as to receive the transparent plate 98. FIGS. 22A and 22B show the same arrangement but with a rigid backing member 24 formed by injection molding.

Figure 23A:
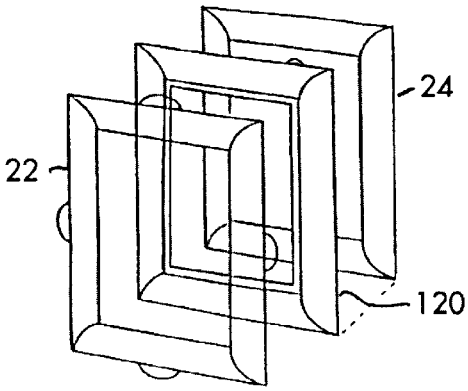
FIGS. 23A and 23B illustrate a embodiment of the picture frame of the present invention wherein the base member and backing members are of a rigid plastic construction.
Figure 24A:
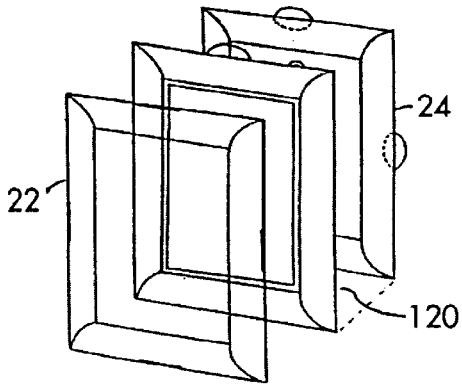
FIGS. 24A and 24B illustrate a embodiment of the picture frame of the present invention wherein the base member and backing members are of a rigid plastic construction.
Figure 23B:
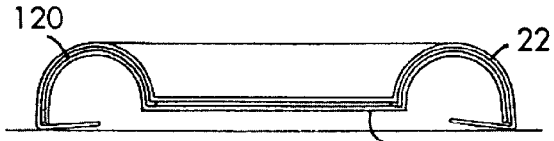
Figure 24B:
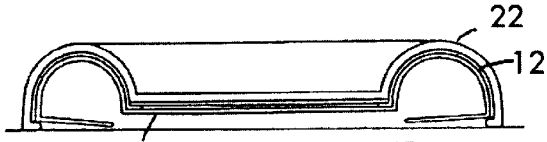

FIGS. 23A and 23B, along with FIGS. 24A and 24B, illustrate yet another embodiment of the present invention. The frames of FIGS. 23A and 23B are formed by flexible plastic as described above. In the case of FIGS. 24A and 24B, the backing member 24 is rigid, being formed by injection molding. In both figures, an insert 120 is sandwiched between the base and backing members. Insert 120 can be a very thin, plastic overlay which can be a different color or a graphic for a particular frame to thereby change the appearance of the frame quickly and easily.

Figure 25:
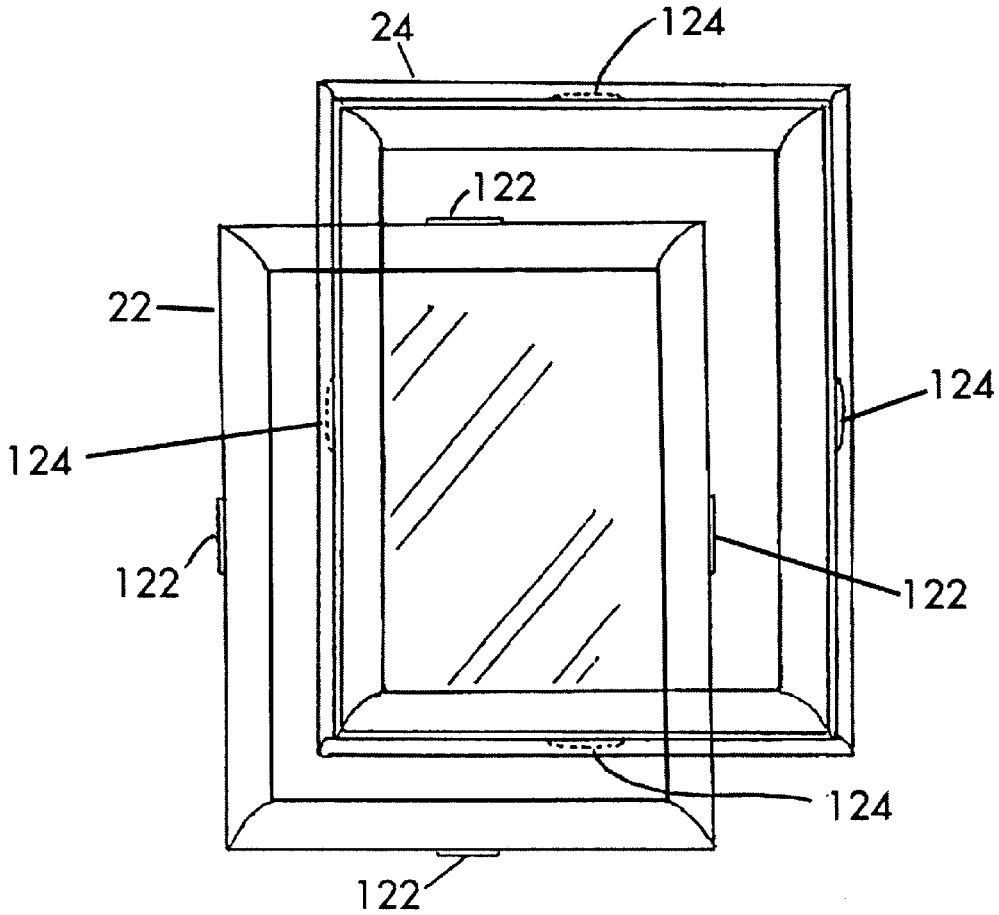
FIG. 25 is another embodiment of the present invention utilizing an alternative locking means.
Figure 26:
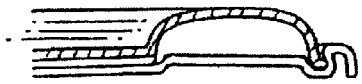
FIG. 26 illustrates yet another locking means.
Figure 27:
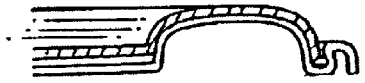
FIG. 27 illustrates yet another locking means.

FIG. 25 illustrates another embodiment of the present invention similar to that of FIG. 14. Locking tabs 48 are replaced with four ridge portions 122 of about ½ inch in length molded into the outside edge of the base member 22. Backing member 24 has four notches 124 molded into the edges having approximately the same dimensions as the ridge portions 122. By overlaying the base member 22 and backing member 24 and by pressing the four ridge portions 122 into the four receiving notches 124 the two sections interlock, yet can also easily be disengaged to open and separate the base and back members. The number and length of the ridges and notches is determined by the overall size of the frame. For example, with small frames only two notches and ridges would normally be required. Other locking means are shown in FIGS. 26 and 27.

Colors, printed imagery, business graphics, logos, sports emblems, cartoon characters and the like may be printed on the base or backing member in the embodiments described above. This is shown, for example, in FIGS. 28A and 28B.

Figure 28A:
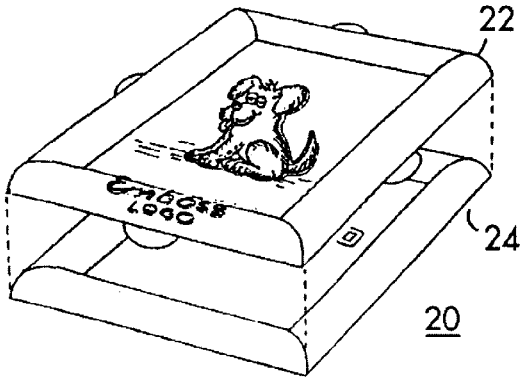
FIGS. 28A and 28B illustrate a picture frame arrangement with embossing along the border section and with a cavity provided between the base member and backing member for volumetric displays.
Figure 29A:
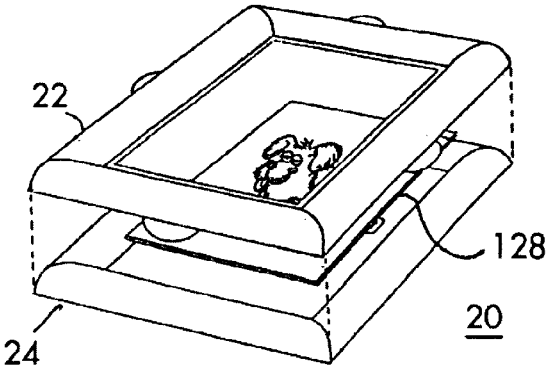
FIGS. 29A, 29B and 29C illustrate the picture frame of FIGS. 28A and 28B except that a separate transparent plate is provided.
Figure 28B:
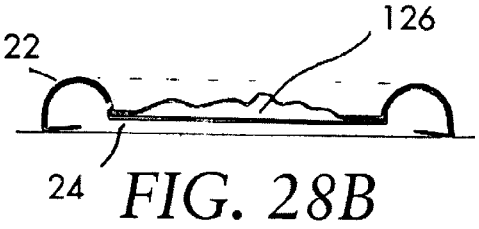
Figure 29B:
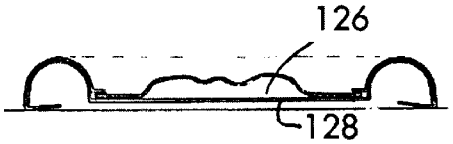
Figure 29C:
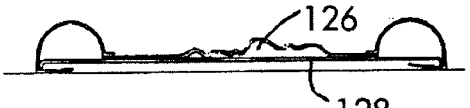
Figure 30:
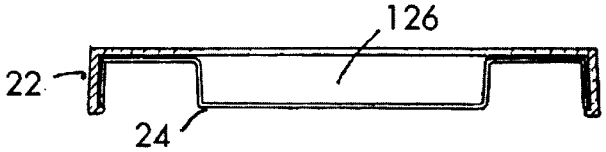
FIG. 30 illustrates an alternative embodiment of the picture frame of FIGS. 28A and 28B.
Figure 31:
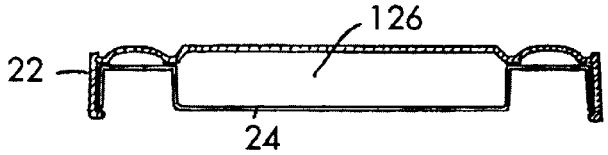
FIG. 31 illustrates an alternative embodiment of the picture frame of FIGS. 28A and 28B.
Figure 32:
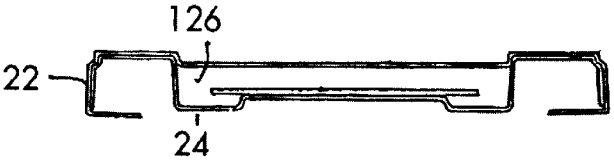
FIG. 32 illustrates an alternative embodiment of the picture frame of FIGS. 28A and 28B.

FIGS. 28A and 28B also illustrate another aspect of the present invention. In these figures the base member 122 is formed with a raised center section so as to define a cavity 126. Cavity 126 accepts three-dimensional objects such as a booklet, medallion or other relieved or volumetric object to be presented in a "framed" manner. FIGS. 29A, 29B, and 29C show additional frames with three-dimensional cavities or spaces but with a separate plate or lens 128. FIGS. 30, 31 and 32 show other alternative embodiments which have a three-dimensional area or pocket to provide a space for relieved volumetric objects.

It should be understood that the picture frame of the present invention is not limited to rectilinear or oval shapes. In fact, specially shaped, non-rectangular frames in practically any shape or configuration may be employed as specialty frames, ornaments, mobile hanging objects, and the like.

In accordance with another embodiment of the invention, the frame structure of the present invention can be configured as a group of multiple frames which function as "planes" to form a volume such as a cube or cylinder. The multiframe unit can be fitted to an existing structure or simply form a container-like object itself when properly linked.

Figure 33A:
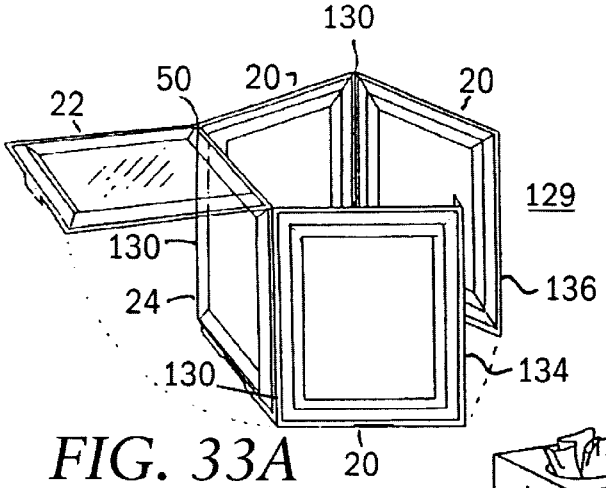
FIGS. 33A, 33B and 33C illustrate a three-dimensional picture frame arrangement in accordance with the present invention.
Figure 33C:
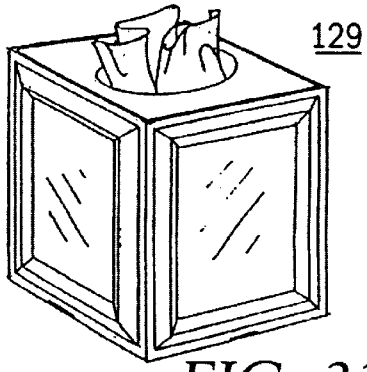
Figure 33B:
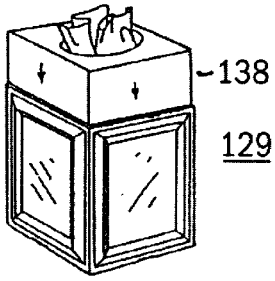
Figure 40:
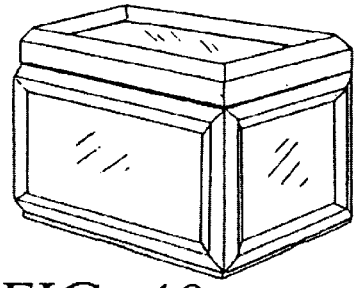
FIGS. 34–40 illustrate other three-dimensional configurations of the picture frame of the present invention.
Figure 35:
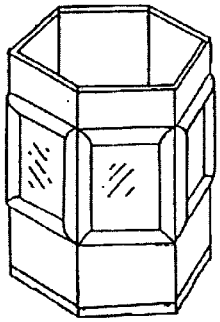
Figure 36:
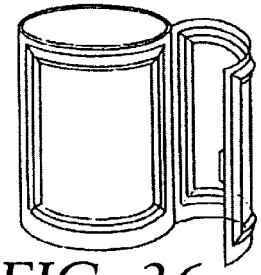
Figure 34:
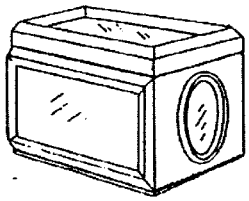
Figure 38:
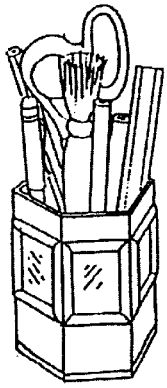
Figure 37:
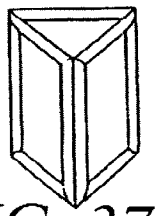
Figure 39:
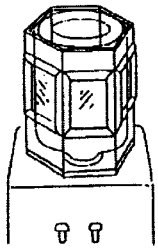

FIG. 33A shows the construction of one such cube-configured structure 129. In addition to the hinge 58 connecting the base member 22 to the back member 24, respective frames 20 are connected by hinges 130. In FIG. 33B, the configuration of FIG. 32A is attached along edges 134 and 136 to form a completed cube 129. Here a tissue box 138, for example, is inserted within the cube 129. In its completed form, the structure 129 appears in FIG. 33C. Other three-dimensional embodiments are shown in FIGS. 34 through FIGS. 40.

Figure 41C:
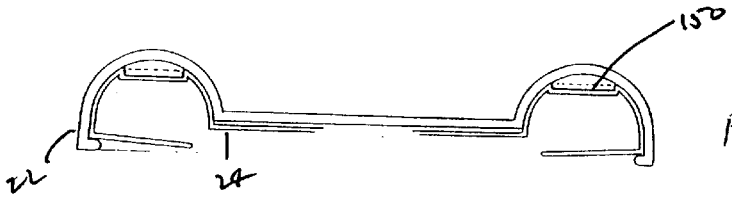
FIGS. 41A, 41B and 41C illustrate another embodiment of the invention to accommodate a flat paper matte insert.
Figure 41B:
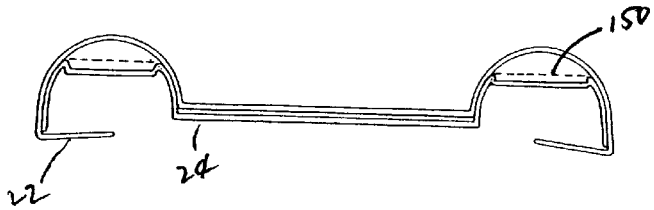
Figure 41A:
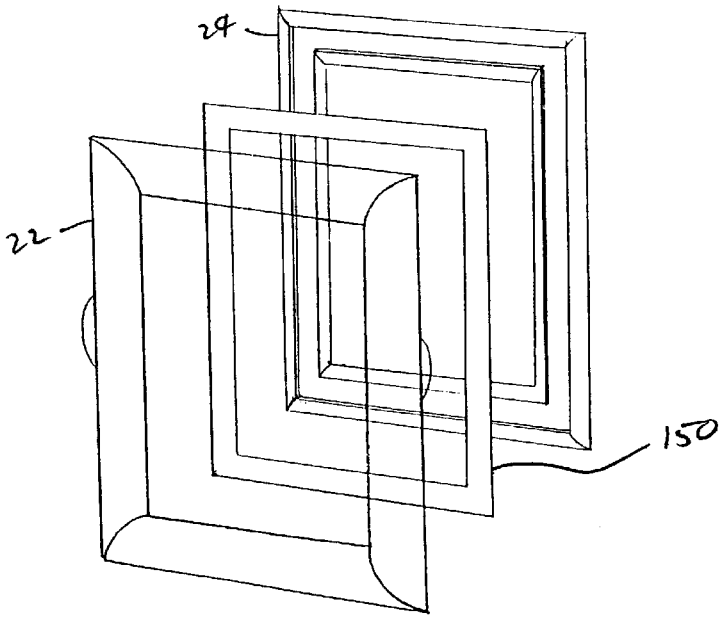

FIGS. 41A, 41B and 42C illustrate another embodiment of the present invention which employs a flat paper matte 150 which is sandwiched between the base member 22 and backing member 24. The matte 150 can be made from different materials such as gold foil, marbleized paper and the like to create different frame appearances.

Of course, the previous descriptions of the various frame structure and variations, such as injection molding, vacuum forming, color plastic inserts, molding design variations and the like can be applied in the three-dimensional embodiment described above.

What is claimed:

1. A picture frame comprising:

a base member vacuum formed from a thin, flexible plastic sheet material and having a transparent planar center section, said planar center section having a peripheral edge, a border section integrally connected to said peripheral edge, said border section totally enclosing said planar center section;

a backing member vacuum formed from a thin, flexible plastic sheet material, said backing member being substantially the same configuration and the same size as said base member, said backing member mating with said base member to form a picture receiving compartment between said base member and said backing member;

locking means for connecting said backing member to said base member, wherein said locking means comprises a plurality of tabs each movable between a locking position and an unlocking position; and wherein the plastic sheet materials of the base and the backing member each have a thickness of less than one thirty-second of an inch.

2. The picture frame as defined in claim 1 with said border section of the base member having a curved portion that is concave with respect to the backing member and with a border section of the backing member having a curved portion that is convex with respect to the base member, said curved portions extending to and terminating at, an outer perimeter of the respective border sections.

3. The picture frame as defined in claim 1 wherein said base number is hingedly connected to said backing member.

4. The picture frame as defined in claim 1 wherein said base member is integrally connected to said backing member.

5. The picture frame as defined in claim 1 wherein said plurality of tabs are integral with said base member.

6. The picture frame as defined in claim 1 including an attachment having an upper end and a lower end, said lower end being wider in width than said upper end, said upper end including a flared tip section which passes through a pair of slits formed in said backing member to lockingly connect said attachment to said backing member, whereby said lower end is located a spaced distance from said backing member to permit said picture frame to stand in an upright position with said lower end and said border section resting on a supporting surface.

7. The picture frame as defined in claim 6 wherein a second pair of slits are formed within said backing member, wherein each of said two pairs of slits are located spaced apart and angularly displaced from each other, said attachment connectable with either of said pair of slits, and wherein attachment with one of said pair of slits locates said picture frame in a first orientation, and wherein attachment with the remaining pair of slits locates said picture frame in a second orientation, said second orientation being ninety degrees displaced relative to said first orientation.

8. The picture frame of claim 1 wherein both the backing member and the base ember are made of a rigid plastic material.

9. The picture frame of claim 1 wherein the backing member is made of a flexible plastic material and the base member is made of a rigid plastic material.

10. The picture frame of claim 1 wherein the plastic sheet material of the base and the backing member are each 0.01 to 0.02 inches thick.

11. The picture frame of claim 10 wherein the plastic sheet material of the base and the backing member are each 0.01 to 0.02 inches thick.

12. A picture frame comprising:

a base member vacuum formed from a thin, flexible plastic sheet material and having a transparent planar center section, said planar section having a peripheral edge, a border section integrally connected to said peripheral edge and enclosing said center section, said border section being non-planar;

a backing member vacuum formed from a thin, flexible plastic sheet material, said backing member being substantially the same size as said base member and hingedly connected thereto, said backing member matable with said base member in an interlocking relationship;

a picture receiving compartment formed between said base member and said backing member, said picture receiving compartment adapted to contain a picture;

locking means for securely connecting said backing member to said base member, wherein said locking means is movable between a locked position and an unlocked position and wherein said locking means comprises a plurality of separate locking tabs; and wherein the plastic sheet materials of the base and the backing member each have a thickness of less than one thirty-second of an inch.

13. The picture frame as defined in claim 10 with said border section of the base member having a curved portion that is concave with respect to the backing member and with a border section of the backing member having a curved portion that is convex with respect to the base member, said curved portions extending to, and terminating at an outer perimeter of the respective border sections.

14. The picture frame as defined in claim 10 wherein an attachment having an upper end and a lower end, said lower end being wider in width than said upper end, said upper end including a flared tip section which passes through a pair of slits formed in said backing member to lockingly connect said attachment to said backing member, whereby said lower end is located a spaced distance from said backing member to permit said picture frame to stand in an upright position with said lower end and said border section resting on the supporting surface.

15. The picture frame as defined in claim 14 wherein said picture frame is in the shape of a four sided polygon, said attachment being mounted on said backing member so as to permit said picture frame to be locatable in a standing easel position with any one of two of said sides of said border section resting on the supporting surface.

16. A picture frame comprising:

a base having a transparent planar center section, the planar center section having a peripheral edge, a first non-planar border section integrally connected to the peripheral edge, the first border section enclosing the planar center section;

a backing member which mates with the base member to sandwich a picture therebetween and having a second border section which is non-planar and mates with the first border section of the base member;

locking means for connecting said backing member to said base member, wherein said locking means comprises a plurality of tabs each movable between a locking position and an unlocking position; and wherein the base member is made of a rigid material and the backing member is made of a flexible material.

17. A picture frame comprising:

a base member vacuum formed from a plastic sheet material and having a transparent planar center section, said planar center section having a peripheral edge, a border section integrally connected to said peripheral edge, said border section totally enclosing said planar center section;

a backing member vacuum formed from a plastic sheet material, said backing member being substantially the same configuration and the same size as said base member, said backing member mating with said base member to form a picture receiving compartment between said base member and said backing member; and locking means for connecting said backing member to said base member, wherein said locking means comprises a plurality of tabs each movable between a locking position and an unlocking position; and wherein both the backing member and the base member are made of a rigid plastic material.

18. A picture frame comprising:

a base member vacuum formed from a plastic sheet material and having a transparent planar center section, said planar center section having a peripheral edge, a border section integrally connected to said peripheral edge, said border section totally enclosing said planar center section;

a backing member vacuum formed from a plastic sheet material, said backing member being substantially the same configuration and the same size as said base member, said backing member mating with said base member to form a picture receiving compartment between said base member and said backing member; and locking means for connecting said backing member to said base member, wherein said locking means comprises a plurality of tabs each movable between a locking position and an unlocking position; and wherein the backing member is made of a flexible plastic material and the base member is made of a rigid plastic material.

19. A picture frame comprising:

a base member vacuum formed from a thin, flexible plastic sheet material and having a transparent planar center section, the planar center section having a peripheral edge, a first non-planar border section integrally connected to the peripheral edge, the first border section enclosing the planar center section and having at least one substantially straight outer peripheral edge;

a backing member vacuum formed from a thin, flexible plastic sheet material and of substantially the same size as said base member which mates with the base member to sandwich a picture therebetween and having a second border section which is non-planar and mates with the first border section of the base member, the second border section also having at least one straight outer peripheral edge;

with said first border section of the base member having a curved portion that is concave with respect to the backing member and second border section of the backing member having a curved portion that is convex with respect to the base member, said curved portions extending to, and terminating at, an outer perimeter of the respective border sections;

wherein said backing member and said base member are joined along said straight peripheral edges to define a hinge between the base member and the backing member; and wherein the plastic sheet materials of the base and the backing members each have a thickness of less than one thirty-second of an inch.

* * * * *